United States Patent [19]

Du

[11] Patent Number: 4,540,349

[45] Date of Patent: Sep. 10, 1985

[54] AIR DRIVEN PUMP

[76] Inventor: Benjamin R. Du, 12 Morgan, Irvine, Calif. 92714

[21] Appl. No.: 610,957

[22] Filed: May 16, 1984

[51] Int. Cl.[3] ..... F04B 9/12

[52] U.S. Cl. ..... 417/393; 91/341 A; 91/346

[58] Field of Search ..... 417/393; 91/346, 350, 91/341 R, 341 A

[56] References Cited

U.S. PATENT DOCUMENTS

| | | | |
|---|---|---|---|
| 740,892 | 10/1903 | Meyer | 417/393 |
| 2,798,440 | 7/1957 | Hall | 417/393 |
| 4,008,984 | 2/1977 | Scholle | 417/393 |

FOREIGN PATENT DOCUMENTS

| | | | |
|---|---|---|---|
| 1138637 | 10/1962 | Fed. Rep. of Germany | 417/393 |
| 785597 | 8/1935 | France | 417/393 |
| 144945 | 1/1931 | Switzerland | 91/341 A |

*Primary Examiner*—Leonard E. Smith

*Attorney, Agent, or Firm*—Hubbard, Stetina & Brunda

[57] ABSTRACT

This invention relates to an improved air driven pump for pumping products such as beverage syrups. Two opposed pistons are mounted on a common piston shaft for reciprocal movement within a housing. Cavities corresponding to the pistons are alternately vented and pressurized to intake the product into a pair of cylinders and to drive the pistons to pump the product. A spool valve stem extends into the cavity being vented so that the piston performing an intake stroke moves the valve stem into the other cavity. A pair of axial passages and corresponding side openings in the valve stem provide fluid flow paths for venting and pressurizing the cavities. A valve body biased toward the cavity being vented includes a vent passage for alternately venting the cavities through the side inlets. While one cavity vents, pressurized fluid flows into the other cavity through the corresponding side inlet and axial passage. The valve body moves with the valve stem until the biasing spring is in an unstable over center position, where the bias reverses to urge the valve body toward the other cavity.

8 Claims, 9 Drawing Figures

Fig. 6
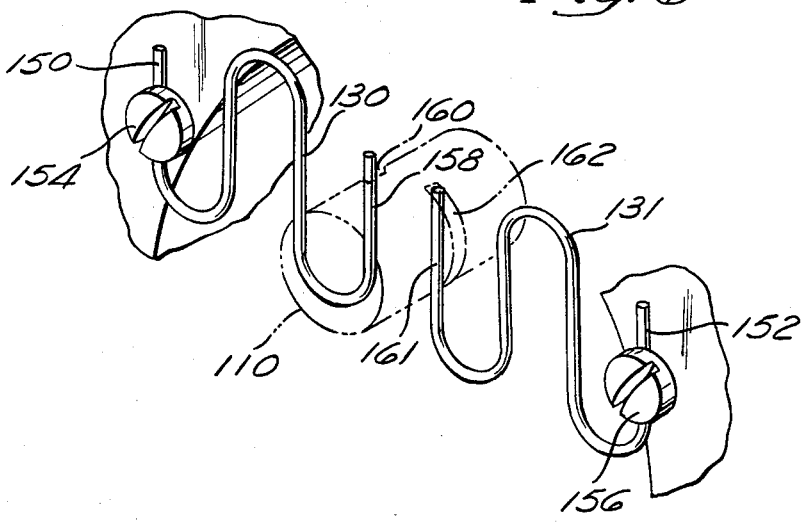
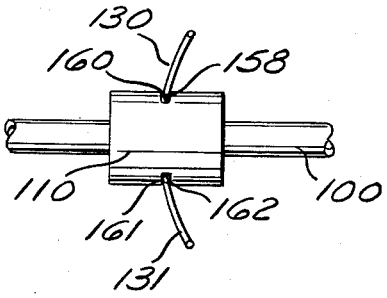
Fig. 7a
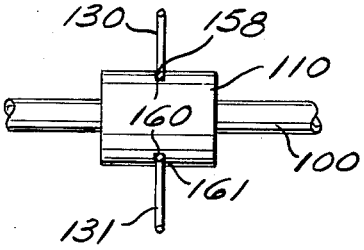
Fig. 7b
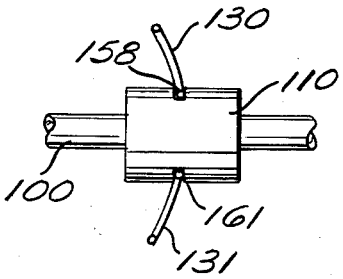
Fig. 7c

AIR DRIVEN PUMP

BACKGROUND OF THE INVENTION

This invention relates to an improved air driven pump apparatus and method for pumping a product such as a beverage syrup used in carbonated beverages. More particularly, the present invention relates to a pumping apparatus and method for providing a constant, low flow rate without mixing air or other impurities into the product being pumped.

As is well known, a variety of beverages are marketed to retail consumers by dispensing systems which simultaneously deliver a metered quantity of flavored syrup with a proportional quantity of carbonated water or the like. For sanitation and economic concerns, the beverage industry typically supplies these flavored syrups in collapsible bag-in-box containers which are adapted to be connected to suitable prior art dispensing systems.

The majority of the prior art dispensing systems have utilized low flow rate pumps for drawing the syrup from the bag container and supplying a metered quantity of the syrup to a mixing nozzle. The use of such low flow rate pumps has been advantageous for system reliability concerns. The syrups are normally concentrated and are mixed with relatively large volumes of carbonated water which means that undesired small variations in the quantity of syrup supplied will produce wide variations in the taste and quality of the final mixed product. Although prior art dispensing systems have generally proven suitable for their intended purposes, they possess inherent deficiencies which have detracted from their overall effectiveness and use in the trade. Fore most of these deficiencies has been the inability of the prior art dispensing systems to eliminate the ingestion of air into the pump and then mixing the air with the product being dispensed. Inducing air into the dispensing system typically occurs when the pump encounters a syrup depletion condition within the syrup bag container. As will be recognized, air ingestion into the dispensing system necessarily introduces inaccuracy in the quantity of dispensed syrup and thus adversely affects the quality of the resultant beverage. In extreme cases, air ingestion causes overheating the permanent damage to the pump of the dispensing system. Although these air ingestion deficiencies have been recognized to a limited extent in the air, the solutions to date have typically been ineffective or have used devices so complicated that they are excessively expensive and unreliable.

Thus, there exists a substantial need in the art for a reliable, relatively inexpensive apparatus and method for dispensing syrup at a low flow rate suitable for properly dispensing the syrup through a nozzle and which prevents air ingestion into the dispensing system.

SUMMARY OF THE INVENTION

The present invention overcomes the difficulties associated with prior art food and beverage product distributing pumps. The invention provides an air driven pump having two opposed pistons mounted on a common shaft. The pistons reciprocate within corresponding cavities in a pump housing. The cavities are alternately supplied with a pressurized gas and vented to accomplish the desired pumping action. Each piston has a corresponding cylinder that fills with the product while the piston is in its intake stroke. Each piston has an exhaust stroke in which it forces the product from the corresponding cylinder into an outlet passage and out of the pump through an outlet orifice. Since the pistons are mounted on the same shaft, while one piston is in its intake stroke, the other piston is in the exhaust stroke.

Application of pressurized gas to the cavities to move the pistons is controlled by a spool valve. The spool valve includes a spool valve stem having separate axial passages therein for alternately placing the piston cavities in communication with a source of pressurized gas such as air or carbon dioxide. Each axial passage includes a side opening through which pressurized air is supplied to the cylinders and through which the cylinders are vented during the intake stroke. The pistons cause the spool valve stem to reciprocate within the pump housing. The stroke of the pistons is larger than the stroke of the spool valve stem so that during the intake stroke, a piston moves a predetermined distance before contacting the end of the spool valve that extends to the corresponding cavity. After contacting the end of the spool valve, the piston pushes the spool valve stem into the other cavity. Initially, the venting cylinder is in fluid communication through the corresponding cavity in the spool valve stem with the ambient pressure and the other cylinder is in fluid communication with the high pressure gas source which drives the cylinders. A spool valve body rides with the spool valve stem toward the cavity being pressurized. A spring biases the spool valve stem toward the cavity into which the spool valve stems extends the farthest. As the spool valve stem reaches the over-center position, the spring changes its bias from the cavity being vented to the cavity being supplied with pressurized fluid, which moves the spool valve body to a position to permit repressurization of the vented cylinder and to vent the cylinder last pressurized. The spring and spool valve body are in unstable equalibrium at the over-center position so that the spool valve stem never ceases its motion at the over-center position which would pressurize both cavities equally and prevent continuous operation of the pump. The pistons and spool valve cooperate to provide a relatively large volume of pumped product with relatively small movement of the spool valve stem.

The present invention is economical, relatively mechanically simple compared to previous food product pumping devices and is highly reliable in long term continuous operation.

BRIEF DESCRIPTION OF THE DRAWINGS

FIG. 6 is a perspective view illustrating a spring included in the valving mechanism of FIG. 5; and FIGS. 7a–7c illustrate positions of a valve body and the configuration of the valve spring during operation of the pump of FIGS. 1–5.

DESCRIPTION OF THE PREFERRED EMBODIMENT

Figure 1:
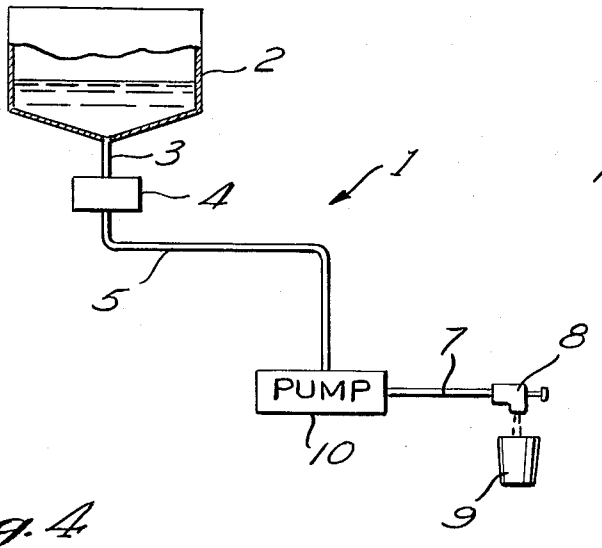
FIG. 1 is a schematic representation of a beverage syrup dispensing system 1.

FIG. 1 shows a schematic representation of a beverage syrup dispensing system 1 including a syrup storage reservoir 2 connected by a conduit 3 to an air trap 4. After flowing through the air trap filter 4, the syrup passes through a conduit 5 to a fluid driven pump 10. The pump 10 forces the syrup through a conduit 7 that terminates in a nozzle 8 for selectively dispensing the syrup to a container 9.

Figure 3:
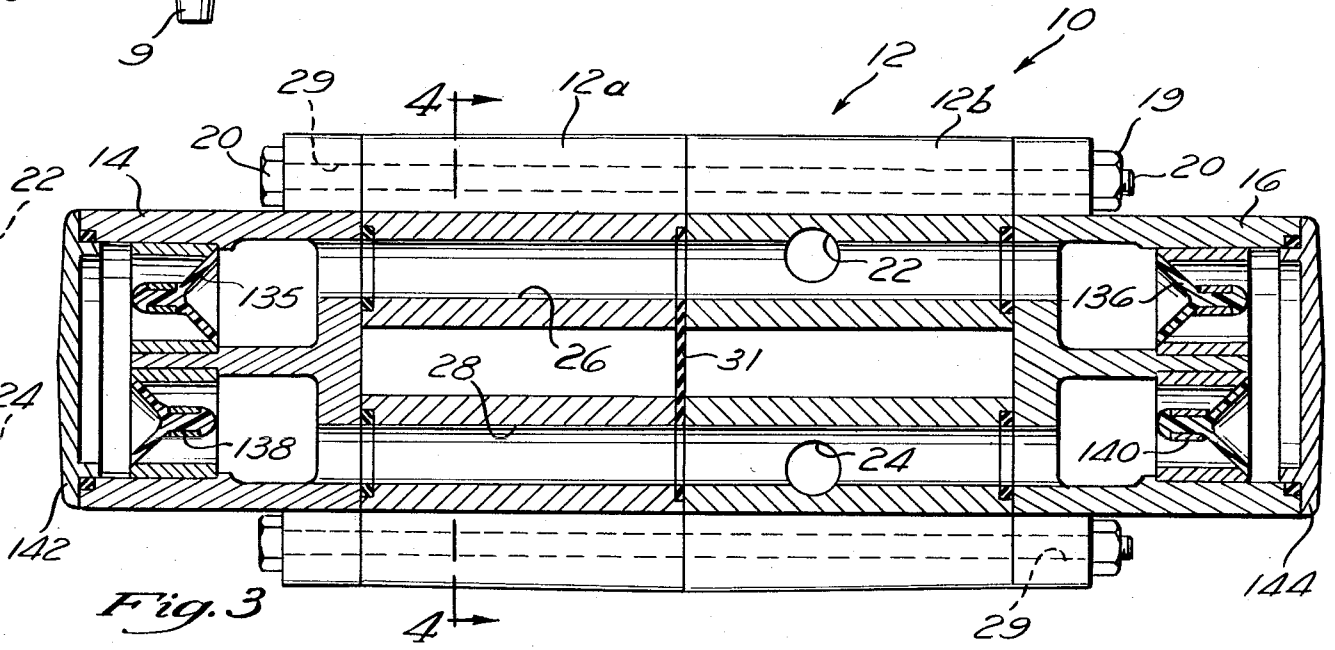
FIG. 3 is a cross-sectional view of the invention illustrating the pump body, cylinder housings and fluid intake and outlet orifices.
Figure 2:
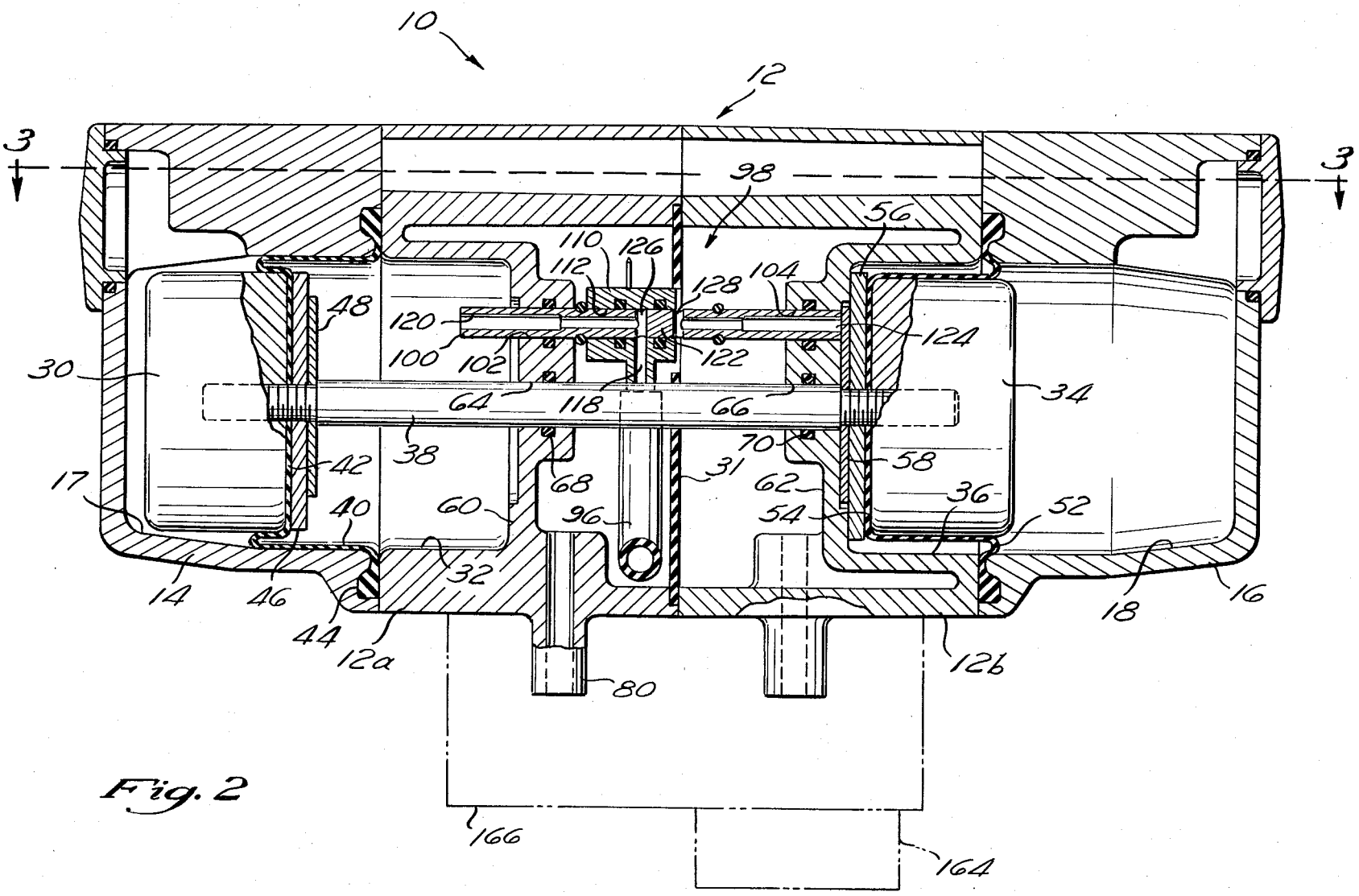
FIG. 2 is a cross-sectional view illustrating the pistons being mounted on their common shaft and the spool valve mechanism that controls application of pressurized gas to the pistons.

Referring to FIGS. 2 and 3, the fluid-powered pump 10, according to the invention, includes a pump housing 12, a first cylinder housing 14 and a second cylinder housing 16 mounted to opposite sides of the pump housing 10 by any convenient means such as a plurality of matching nuts 19 and bolts 20. The cylinder housings 14 and 16 contain a cylinder 17 and a cylinder 18, respectively. The pump housing 12 includes a fluid intake orifice 22 and a fluid outlet orifice 24. The fluid intake orifice 22 is in fluid communication with both of the cylinders 17 and 18 through an inlet passage 26, and the fluid outlet orifice 24 is in fluid communication with both of the cylinders 14 and 16 through an outlet passage 28.

Figure 4:
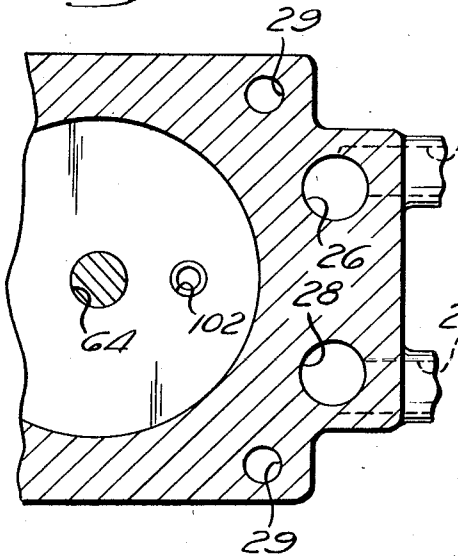
FIG. 4 is a cross-sectional view taken along line 4—4 of FIG. 3.

The pump housing 12 may be conveniently formed to include a pair of housing sections 12a and 12b for ease of manufacture and assembly components, and for convenience in inspection, cleaning and maintenance. The housing sections 12a and 12b include passages, such as the passages 29 of FIGS. 3 and 4, through which the bolts 20 extend when the pump 10 is fully assembled. A gasket 31 is positioned between the housing sections 12a and 12b as shown in FIGS. 2 and 3 to provide a seal.

A piston 30 is positioned for reciprocal movement in the cylinder 17 and in a cavity 32 in the end of the pump housing 12, in axial alignment with the cylinder 17. A piston 34 is positioned for reciprocal movement in the cylinder 18 and in a cavity 36 in the other end of the pump housing 12 in axial alignment with the cylinder 18. A piston shaft 38 connects the pistons 30 and 34 together so that they always move in unison. The piston 30 is shown at the outer limit of its range of motion away from the pump housing 12; and the piston 34 is, therefore, at the inner limit of its range of motion toward the pump housing 12.

When the piston 34 moves toward the inner position shown in FIG. 2, fluid enters the inlet orifice 22 and flows through the inlet passage 26 into the cylinder 18. At the same time, the piston 30 pushes fluid out of the cylinder 17 into the outlet passage 28 and through the outlet orifice 24.

A rolling diaphragm 40 is positioned between the inner end 42 of the piston 30 and the pump housing portion 12. An outer edge 44 of the rolling diaphragm 40 is secured by the bolts 20 between the cylinder 14 and the pump housing 12. A diaphragm retainer 46 and a retainer washer 48 retain the rolling diaphragm 40 in position against the end 42 of the piston 30. The rolling diaphragm 40 moves with the end 42 of the piston 30 as the piston 30 reciprocates relative to the pump housing 12. A rolling diaphragm 52, substantially identical to the rolling diaphragm 40 is mounted between the inner end 54 of the piston 34 and the pump housing portion 12b. A diaphragm retainer 56 and a retainer washer 58 retain the rolling diaphragm 52 in position. The rolling diaphragms 40 and 52 prevent fluid flow between the cavity 32 and the cylinder 17 and the cavity 36 and the cylinder 18.

The pump housing 12 contains a wall 60 at one end and a substantially identical wall 62 at the other end. The walls 60 and 62 separate the cavities 32 and 34, respectively from the interior of the pump housing 12. The piston shaft 38 passes through a pair of aligned passages 64 and 66 in the walls 62 and 64, respectively. An O-ring 68 forms a seal between the wall of the passage 64 and the piston shaft 38 to prevent leakage. An O-ring 70 substantially identical to the O-ring 68 forms a seal between the wall of the passage 66 and the piston shaft 38.

An air intake tube 80 extends from the pump housing 12. The air intake tube 80 is connected to a source (not shown) of pressurized fluid, probably a gas such as air or carbon dioxide, when the pump 10 is in operation. The pressurized fluid is used to cause reciprocal motion of the pistons 30 and 34 in a manner explained below. After being used to drive the pistons 30, 34 the gas exits the pump housing 12 via an air exhaust hose 96.

Figure 5:
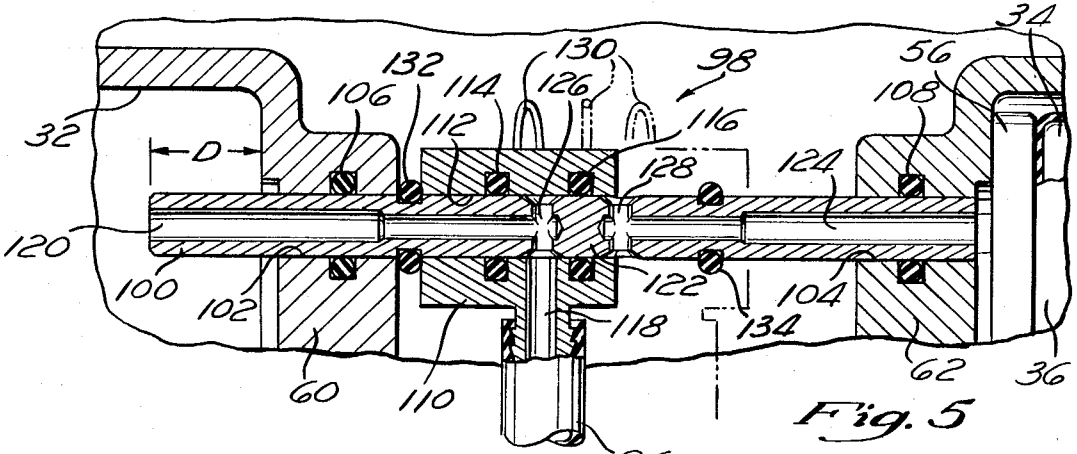
FIG. 5 illustrates details of a valving mechanism shown in FIG. 2.

Referring to FIGS. 2 and 5, a spool valve assembly 98 is mounted in the pump housing 12 for controlling application of high pressure gas to the cavities 32 and 36 for providing forces to reciprocate the pistons 30 and 34 within the cylinders 17 and 18, respectively. A spool valve stem 100 is positioned in a pair of axially aligned passages 102 and 104 in the walls 60 and 62, respectively. An O-ring 106 forms a seal between the spool valve stem 100 and the wall 60. Similarly, an O-ring 108 forms a seal between the spool valve stem 100 and the wall 62.

The spool valve 98 assembly further includes a spool valve body 110 mounted upon the spool valve stem 100 through a central passage 112 in the spool value body 110. A pair of spaced apart O-rings 114 and 116 forms seals between the spool valve body 110 and the spool valve stem 100, while permitting the spool valve body 110 and the spool valve stem 100 to be slidable relative to one another. The spool valve body includes a vent outlet 118 between the O-rings 114 and 116 connected to the exhaust hose 96.

The spool valve stem 100 includes a first axial passage 120 that is in fluid communication with the cavity 32 when the piston 30 is spaced apart from the wall 60. The passage 120 terminates near a central portion 122 of the spool valve stem. A second axial passage 124 extends through the spool valve stem 100 to be in fluid communication with the cavity 36 when the piston 34 is spaced apart from the wall 62. The passage 124 also terminates at the central portion 122 of the spool valve stem 100 so that the passages 120 and 124 are not in fluid communication with one another.

The spool valve stem includes a pair of side inlets 126 and 128 that are in fluid communication with the passages 120 and 124, respectively. The side inlet 120 is shown aligned with the vent outlet 118 so that pressurized gas in the cavity 32 is vented through the passage 120, the side inlet 126, the vent outlet 118 and the air exhaust tube 96 to ambient pressure.

While the side inlet 126 is aligned with the vent outlet 118, the side inlet 128 is in fluid communication with high pressure gas inside the pump housing 12. The cylinder 18 fills with a product to be pumped out of the fluid outlet orifice 24. After the cavity 32 has vented to a predetermined pressure and the pressure against the piston 34 has attained a value higher than the pressure in the cavity 32, the pistons 30 and 34 begin to move to the right as seen in FIG. 2. When the piston 30 moves against the spool valve stem 100, the spool valve stem 100 moves within the pump housing 12 to align the vent tube 118 with the side inlet 128. The spool valve body 110 initially moves with the spool valve stem 100 against a biasing force, preferably provided by the pair of a spool valve springs 130, 131, best shown in FIG. 6. FIG. 2 shows the spool valve body 100 at an extremity of its range of motion in the spool valve body 110. A stop 132 limits movement of the spool valve body 100 toward the left and a stop 134 limits movement of the spool valve body 110 to the right as shown in FIG. 2. The spool valve springs 130, 131 bias the spool valve body 110 against one of the stops 132 or 134 until the spool valve stem 100 moves to the over-center position, at which time the bias of the spool valve springs 130, 131 rapidly changes direction to fully reciprocate the spool valve body relative to the spool valve shaft 100.

After the product has been pumped from the cylinder 17, the piston 34 moves the spool valve stem 100 out of the cavity 36. The side inlet 128 is aligned with the vent tube 118 to relieve the pressure in the cavity as the cavity 36 in the manner described above with reference to the cavity 32. Product enters the cylinder 32, and the cavity 14 is repressurized. The pistons 30 and 34 move to the left to the position shown in FIG. 2. The above described steps repeat continuously while pressurized gas is supplied to the air intake tube 80 and product is supplied to the fluid inlet orifice 24.

Referring again to FIG. 1, the fluid inlet passage 26 includes a pair of inlet check valves 135 and 136, and the fluid outlet passage includes a pair of outlet check valves 138 and 140. The inlet check valve 135 permits product to flow into the cylinder 17 as the piston 30 undergoes its intake stroke, or moves to the right as seen in FIG. 1. The inlet check valve 136 performs a similar function for the cylinder 18 as the piston 34 moves to the left. When the piston 30 is moving away from the pump housing 12 during the exhaust stroke, the inlet check valve 135 closes, and the outlet check valve 138 opens to permit product to flow from the cylinder 17 into the outlet passage 28. The outlet check valve 138 closes during the exhaust stroke of the piston 34 to prevent reverse flow of product from the outlet passage 26 into the cylinder 17. Similarly, the inlet check valve 136 closes and the outlet check valve 140 opens during the exhaust stroke of the piston 36. The outlet check valve 140 closes during the intake stroke of the piston 36, or the exhaust stroke of the piston 34, to prevent reverse flow of product from the outlet passages 26 into the cylinder 16. A pair of cylinder covers 142 and 144 are mounted to the cylinder housings 14 and 16, respectively, to enclose the valves 135, 138 and 136, 140, respectively. Suitable bolts (not shown) attach the cylinder covers 142 and 144 to the cylinder housings and 16, respectively. The cylinder covers isolate the valves 135, 136, 138 and 140 from the ambient environment to assure clean operation of the pump 10. The cylinder covers 142, 144 may be easily removed when it is necessary to inspect, clean or repair the pump 10.

FIGS. 6 and *7a–7c* illustrate details of the construction of the spool valve springs 130, 131, which have a pair of ends 150, 152, respectively, secured inside the pump housing 12 by a corresponding pair of screws 154, 156, respectively. The spool valve springs 130, 131 are preferably serpentine in configuration as shown in FIG. 6, with a loop 158 of the spool valve spring 130 being engaged in a slot 160 in the spool valve body 110. The spring 131 has a loop 161 engaged in a slot 162 in the spool valve body 110. FIG. *7a* represents the configuration of the loop 158 during the biasing action of the spool valve springs 130, 131 when the spool valve stem 100 is in the position shown in FIG. 2. The screws 154, 156 retain the spool valve springs 130, 131, respectively, in compression so that when the spool valve stem 100 is pushed to the left of center by the piston 34, the spool valve springs 130, 131 bias the spool valve body 110 against the stop 132. As the spool valve stem 100 moves to the right in response to a force applied by the piston 30, the stop 132 pushes the spool valve body 110 toward the center of the pump housing 12, further compressing the spool valve springs 130, 131. FIG. *7b* shows the spool valve springs 130, 131 at maximum compression when the loops 158, 161 are essentially straight when viewed on edge. The spool valve springs 130, 131 are unstable at the over center position of FIG. *7b* because of the energy stored in the compressed state.

The momentum of the spool valve body 110 carries it beyond the over-center position of the spool valve springs 130, 131, which then reverse bias directions so that the loops 158, 161 assume the configuration of FIG. *7c* to rapidly move the spool valve body against the stop 134, placing the inlet 126 in fluid communication with the pressurized driving fluid and venting the cavity 36 through the passage 124, the inlet 128, the vent outlet 118 and the exhaust tube 96. The exhaust tube 96, being formed of an elastomeric material moves with the vent outlet 118 as the spool valve body reciprocates in the pump housing 12 between the stops 132 and 134.

The pump 10 includes a pressure regulator 164 to interrupt the flow of pressurized gas to the inlet 80 if any interruption should occur in the flow of product to the inlet orifice 22. The pump 10 further includes a regulator 166 for interrupting the flow of pressurized fluid to the inlet 80 if the pressure of the driving fluid is not within specified limits, dependent upon the desired pumping rate. Therefore, the pressure regulators 164 and 166 turn off the pump 10 if there are any pressure irregularities in either the product or the driving fluid being supplied to the pump 10.

Having thus described the structure of the pump 10, the operation thereof is now described in detail.

A pressurized driving fluid is input to the pump housing 12 through the inlet 80. The pressurized driving fluid fills the interior cavity 81 of the pump housing 12 through the inlet 80. The pressurized driving fluid fills the interior cavity 81 of the pump housing 12 and surrounds the spool valve stem 100. When the spool valve body 100 is against the stop 132, the pressurized driving fluid enters the cavity 36 through the side inlet 128 and the axial passage 124. While pressurized driving fluid is supplied to the cavity 36, the cylinder 18 fills with product, the piston 30 forces product out of the cylinder 17, and the cavity 14 vents to ambient pressure through the axial passage 120, the side inlet 126 and the vent outlet 118.

After the pressure in the cavity 36 exceeds the pressure in the cavity 32, the piston 34 begins to move to the right to expel product from the cylinder 18. After the piston 30 has moved through the distance D, it contacts the end of the spool valve stem 100 and pushes it into the pump housing 12. The spool valve body 110 rides with the spool valve stem 100 until the spool valve stem has traversed its maximum stroke D where the spool valve springs 130, 131 are in unstable over-center positions. The spool valve body 110 continues to move relative to the spool valve stem 100, and as the spool valve body 110 passes the over-center positions of the spool valve springs 130, 131, the bias of the spool valve springs 130, 131 moves the spool valve body rapidly against the stop 134.

When the spool valve body 110 is against the stop 134, the cavity 32 is in communication with the pressurized driving fluid in the housing cavity 81 while the cavity 36 vents to the ambient pressure. The cylinder 17 begins to fill with product as the cylinder 18 is emptied. After the pressure in the cavity 32 exceeds that in the cavity 34, the process repeats and continues as long as pressurized driving fluid and product are supplied to the pump 10.

The biasing springs 130, 131 are mounted between the valve body 110 and the pump housing 12, rather than to the pistons 30 and 34, or the shaft 38, which therefore, have no effect on the valve mechanism 98 unless one of the pistons 30, 34 is in contact with the valve stem 100. Having the valve body movable independently of the piston shaft throughout a position of its stroke permits the stroke of the valve body 110 and valve stem 100 to be shorter than the stroke of the pistons 30 and 34, thereby permitting higher pumping rates than ordinary pumps in which the pistons or piston shafts directly actuate the valving mechanisms.

What is claimed is:

1. A fluid-driven pump, comprising:

housing means defining a first cavity, a second cavity, and a third cavity;

a piston shaft slidably positioned within housing means;

a first piston mounted to a first end of the piston shaft;

a second piston mounted to a second end of the piston shaft; the first and second pistons being reciprocally movable through intake and exhaust strokes within the first and second cavities, respectively, for pumping a product therefrom;

means for supplying a pressurized fluid to said third cavity;

valve means disposed within said third cavity having a reciprocable valve stem opposite ends of which extend into said first and second cavities to be actuated by the pistons during portions of the intake strokes for alternately venting and pressurizing the first and second cavities with said pressurized fluid from said third cavity, said valve stem including a first passage and a second passage for alternatively placing the first and second cavities, respectively, in communication with the pressurized fluid from said third cavity and the ambient air pressure;

a valve body slidably mounted along the length of said valve stem for selectively placing the first and second passages in communications with the pressurized fluid within said third cavity and the ambient air pressure; and over-center spring means disposed within said third cavity and cooperating with said valve body for biasing said valve body toward the cavity being vented, said over-center spring means reversing direction as the valve stem travels through a stroke of less length than the distance the pistons travel during their intake and exhaust strokes.

2. The fluid driven pump of claim 1 wherein the housing means includes a product inlet, a product inlet passage, a first cylinder and second cylinder in fluid communication with the product inlet passage during intake strokes of the first and second pistons respectively and a product outlet in fluid communication with the first and second cylinders during exhaust strokes of the first and second pistons, respectively, each cylinder alternately having product input thereto and expelled therefrom as the pistons reciprocate in the housing means.

3. The fluid driven pump of claim 1 wherein the valve stem is movable with the first and second pistons for a selected distance to move the valve body the selected distance away from the cavity being vented, and the over center spring means reverses the bias direction after the valve body has moved the selected distance to place the cavity previously being vented in communication with the pressurized fluid and to vent the cavity previously in communication with the pressurized fluid.

4. The fluid driven pump of claim 3 wherein said over-center spring means comprises a serpentine spring extending from said housing means to said valve body.

5. The fluid driven pump of claim 4 wherein said first and second pistons each comprise a rolling diaphragm.

6. A fluid-driven pump, comprising:

a pump housing including a first cavity, and a second cavity;

a piston shaft slidably mounted within the pump housing to extend between said first and second cavities;

a first piston mounted to a first end of the piston shaft for reciprocating movement within the first cavity through an intake stroke in which a product is drawn into the first cavity and an exhaust stroke in which the product is pumped out of the first cavity;

a second piston mounted to a second end of the piston shaft for reciprocal movement in the second cavity through an exhaust stroke while the first piston moves through its intake stroke and through an intake stroke while the first piston moves through an exhaust stroke for pumping a product therefrom;

a valve stem slidably mounted in the pump housing; the valve stem including first conduit means for alternatively venting and placing the first cavity in communication with a pressurized fluid and second conduit means for alternatively venting and placing the second cavity in communication with the pressurized fluid, the valve stem positioned relative said first and second pistons for moving a selected distance in response to movement of the first and second pistons in the intake strokes thereof;

means responsive to movement of the valve stem through the selected distance for alternately draw the product into the first and second cavities and pump the product therefrom;

a valve body slidable within the housing between a first stop proximate the first cavity and a second stop proximate the second cavity, the valve body venting the first cavity through the first conduit means while placing the second cavity in fluid communication with the pressurized fluid through the second conduit means; and over-center spring means for biasing the valve body against the stop corresponding to the cavity which is venting, the valve body moving with the valve stem for a selected distance, said over-center spring means changing the bias direction after the valve stem has moved the selected distance corresponding to an over-center spring position to move the valve body adjacent the other stop, thereby alternatively pressurizing and venting the first and second cavities.

7. The fluid driven pump of claim 6 wherein said over-center spring means comprises a serpentine spring extending from said housing means to said valve body.

8. The fluid driven pump of claim 7 wherein said first and second pistons each comprise a rolling diaphragm.

* * * * *